US005529191A

United States Patent [19]

Washeim

[11] Patent Number: 5,529,191

[45] Date of Patent: Jun. 25, 1996

[54] MACHINE FOR SORTING ARTICLES ACCORDING TO A CHARACTERISTIC THEREOF

[75] Inventor: Günter Washeim, Bad Kreuznach, Germany

[73] Assignee: Krones AG, Neutraubling, Germany

[21] Appl. No.: 308,122

[22] Filed: Sep. 19, 1994

[30] Foreign Application Priority Data

Sep. 23, 1993 [DE] Germany ..... 43 32 342.1

[51] Int. Cl.[6] ..... B07C 5/00

[52] U.S. Cl. ..... 209/523; 198/370.01; 209/919; 414/416

[58] Field of Search ..... 198/370.01, 370.03, 198/475.1; 209/912, 919, 621, 523, 580; 414/416

[56] References Cited

U.S. PATENT DOCUMENTS

| | | | |
|---|---|---|---|
| 1,906,604 | 6/1933 | Hutchinson | 198/44.3 |
| 2,712,405 | 7/1955 | Rockcastle | 414/416 |
| 2,999,589 | 9/1961 | Norwich | 209/523 |
| 3,148,774 | 9/1964 | Verrinder et al. | 209/580 |
| 4,239,116 | 12/1980 | Eisenberg et al. | 209/523 |
| 4,884,696 | 12/1989 | Peleg | 209/580 |
| 5,105,931 | 4/1992 | Lashyro | 198/471.1 |
| 5,257,888 | 1/1993 | Kronseder | 414/416 |
| 5,314,072 | 5/1994 | Frank et al. | 209/580 |

*Primary Examiner*—William E. Terrell
*Assistant Examiner*—Tamara Kelly
*Attorney, Agent, or Firm*—Ryan, Maki, Mann & Hohenfeldt

[57] ABSTRACT

A plurality of bottle release stations are arranged proximate to the path of movement of a plurality of bottle gripper heads. The gripper heads have grippers which can be switched from a gripping mode to a release mode. Containers of unsorted bottles are conveyed to a pick up station on an infeed conveyor where one of the gripper heads is guided to direct its grippers to the mouths of bottles at which time the grippers are switched to the gripping mode. All of the unsorted bottles in the container are carried to a first release station on an infeed conveyor where bottles having a certain characteristic such as the same color are released by switching the grippers to the release mode. The gripper head, in a continuous motion, then moves to another release station where, by means of a control system, bottles having another characteristic, such as a different color are released. The same procedure occurs at any one or more release stations until all bottles have been deposited at release stations in accordance with their different characteristics. Bottles deposited at the various release stations are conveyed away to various destinations which may include bottle washing machines, bottle filling lines and so forth.

17 Claims, 1 Drawing Sheet

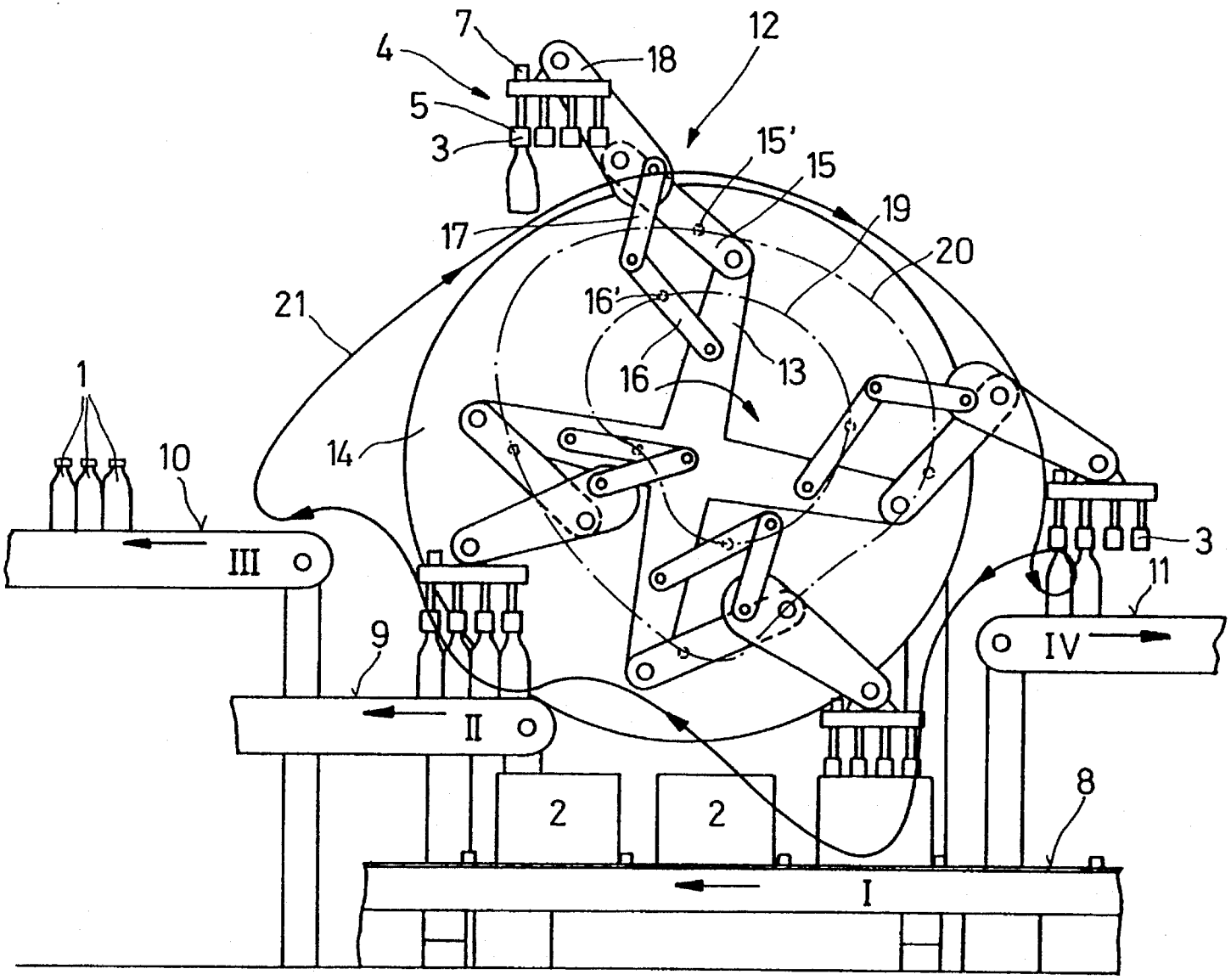
1
2
2
3
3
4
5
7
8
9
10
11
12
13
14
15
15'
16
16'
17
18
19
20
21
I
II
III
IV

MACHINE FOR SORTING ARTICLES ACCORDING TO A CHARACTERISTIC THEREOF

BACKGROUND OF THE INVENTION

The invention disclosed herein pertains to a method and apparatus for removing articles such as glass and plastic bottles from containers such as boxes, cartons and crates and sorting the articles according to their color or other characteristics.

For convenience, glass and plastic bottles and other article configurations that can be processed with the apparatus will be called by the convenient generic term "bottles" herein.

German Patent DE 24 34 183 C3 discloses the concept of removing bottles from conveyed containers and sorting the bottles according to their colors using a scheme wherein several unpacking machines are arranged in series. Each machine is provided with sensors or detectors that are sensitive to and respond to a single color. The first machine withdraws bottles of a first color, such as clear bottles, from each container as it is conveyed past the first machine. The container with bottles having colors other than clear, such as brown and green, remaining in the container, after the first machine are conveyed to the second machine where the bottles of one of the remaining colors are withdrawn and then the container is conveyed to the next machine and so on until bottles of all colors are removed from the containers and are sent along individual paths.

There are two major problems with the preexisting approach outlined above. One is that an individual machine is needed for each bottle color or other distinguishing article characteristic. Thus, an exceedingly large investment must be made in machines. The other problem is that the series of machines take up a lot of floor space by themselves and so do the additional conveyors that are needed with this approach. This might even require a larger building than might otherwise be required if the single multi-color bottle separating machine disclosed herein were installed.

SUMMARY OF THE INVENTION

An objective of the invention is to provide a machine that can remove articles such as bottles from conveyed containers, such as boxes, cartons and crates, sequentially according to their respective colors or other characteristics and can deposit the bottles on individual receiving stations from which they may be collected or otherwise conveyed away.

According to one implementation of the invention, containers filled with variously colored bottles are conveyed to the new bottle unpacking and color discriminating machine. The machine comprises a carrier member, that is, a rotor that rotates about a horizontal axis. The rotor has mounted to it a plurality of articulated lever systems which are equiangularly spaced about the horizontal rotational axis of the rotor. Each lever system has a bottle gripper head pivotally connected to it. Each gripper head has an equal number of selectively engageable and releasable bottle grippers mounted to it. As the rotor rotates about a horizontal axis, each gripper head is maintained in a horizontal attitude on its pivot connection to the articulated lever systems. The gripper heads are transported concurrently along a closed loop irregular or non-circular orbit or path that is coincident with a vertical plane in the preferred embodiment.

Each gripper on a gripper head has a detector affiliated with it that produces an output signal if the bottle that is positionally corresponding to the gripper and that is in view of the detector has a color or other unique characteristic to which the detector is sensitive or tuned. Bottle color sensors affiliated with grippers are known from German DE GM 93 114 112.2.

For convenience, the articles to be sorted will be called bottles herein and for demonstration purposes the bottles will be sorted on the basis of their respective colors. It should be understood, however, that the articles are not necessarily restricted to bottles and characteristics other than color may be utilized as a basis for sorting.

As the containers, filled or partially filled with bottles of various colors arrive at the bottle pick up station on an infeed conveyor, the containers are in phase or coincidence with one of the gripper heads that is following its closed loop orbital path. The grippers on that head engage and lift all of the bottles from the container for carrying them to a first selective release station. An electronic controller on a gripper head or some other location has stored data indicative of which grippers hold bottles of which color. This information is obtained through signals transmitted from the respective color sensitive detectors. The whole group of bottles which the gripper head is now carrying are transported along a segment of the orbital path to a first release station where the controller on the gripper head triggers all grippers holding bottles of only one of the colors to release the bottles. Bottles of other colors retained by the head then traverse through successive release stations at which bottles of the same color are released.

A preliminary bottle characteristic selecting machine can be advantageously positioned in advance of the container infeed zone of the aforesaid machine. The preliminary machine can have its grippers adapted with sensors that sense bottles that have characteristics that disqualify them for use in the particular production line. For example, some bottles in incoming containers may have improper shoulder contour, height, contamination, damage and so forth. Any odd bottles that could not be assigned to any one of the bottle color release stations can remain on the infeed conveyor for being conveyed away. The sensors or detectors and controls of the preliminary inspection machine grippers can be mutually interconnected with the same on the heads that are involved in color selection.

Infeeding bottle transport containers, withdrawing bottles from containers, depositing bottles at the dedicated bottle color release stations and conveying away colored bottles from release stations is continuous in the new machine. Thus, when a gripper head releases bottles of one of the colors at the last release station in its orbital path a new cycle is started beginning with that same head withdrawing all bottles from a container on the infeed conveyor.

Improved bottle processing speed can be achieved with a machine having grippers continuously guided in a closed loop path in the same direction which can lie in a horizontal or vertical plane. This has the advantage of allowing a continuous supply of bottle filled transport containers and a continuous release of bottles at release stations. A further advantage is that the continuous operation allows use of gripper heads that extend out in the direction of conveyor travel. When the gripper heads travel in a horizontal plane, the bottle release stations are also positioned in a horizontal plane and can be arranged offset and behind each other along the plane of travel. It is possible to arrange the bottle release stations offset in height as in a staggered or stepwise fashion.

When the gripper heads are guided in a path which lies in a vertical plane, the conveyor leading from the individual bottle release stations can be arranged in parallel above the conveyor for the infeed of conveyors and in alignment with the same. When conveyors are arranged in this way, very good access to all important areas of the machine is available to service personnel.

How the foregoing objectives and features are achieved and implemented will be more evident in the ensuing more detailed description of a preferred embodiment of the invention which will now be set forth in reference to the drawing.

DESCRIPTION OF THE DRAWING

The single FIGURE is a schematic side elevational view of the essential features of the new machine.

DESCRIPTION OF A PREFERRED EMBODIMENT

The bottle separating machine depicted in the drawing comprises a vertically oriented mounting plate 14 which is secured in a fixed position. A rotor 13 is mounted to mounting plate 14 and is driven continuously in rotation about a horizontal axis. The machine is provided with four gripper heads each of which supports a group of grippers 3. Each gripper head 4 is pivotally connected to a lever 18 of an articulated lever system including levers 15, 16, 17 and 18. Levers 15 and 16 are pivotally connected to one of the arms of rotor 13. Stationary vertical support plate 14 is equipped with two cam grooves 19 and 20. A cam follower roller 15' is journaled for rotation on lever 15 and is compelled to follow cam groove 20 as the rotor 13 rotates. Similarly, lever 16 is provided with a cam follower roller 16' which is compelled to follow cam groove 19 when rotor 13 is driven rotationally in the direction indicated by the arrow near the axis of rotation of rotor 13. Cam grooves 19 and 20 are configured so that the gripper carrying heads 4 describe a closed loop non-circular irregular path of travel somewhat like the path defined by the closed loop 21. The gripper heads 4 are held in horizontal position by means of a drive mechanism, not shown, driving one complete rotation of the rotor 13.

Each gripper 3 has a color sensor 5 affiliated with it. Each carrier head 4 has a control mechanism 7 which is connected with sensors 5 and controls the gripping function of grippers 3 in accordance with bottle color. Control mechanism 7 is also connected with a remote position indicator, not shown, which indicates the instantaneous rotational position of rotor 13.

Bottle containers such as cases 2 filled with unsorted empty bottles are fed to the machine on an infeed conveyor 8 which runs in the horizontal plane. The incoming bottle container coming in on infeed conveyor 8 is having all of the bottles contained in it gripped by the gripper carrier head 4 above it at a station identified by the roman numeral I. No bottle color discrimination nor selection occurs at station I. The direction of travel of infeed conveyor 8 is indicated by the arrow marked thereon. In this embodiment, there are three horizontal distinctively colored bottle outfeed conveyors 9, 10 and 11. Horizontal outfeed conveyors 9, 10 and 11, have zones, respectively, designated as release stations II, III and IV. Note from the indication by the arrows, conveyor belts 9 and 10 translate to the left and conveyor belt 11 translates to the right. Unsorted bottle container infeed conveyor 8 and outfeed conveyor belts 9, 10 and 11 are driven translationally continuously and in synchronism with rotor 13 of the machine. The cam grooves 19 and 20 in vertical plate 14 which determine the irregular orbital path 21 are of such configuration that the gripper heads 4 and their grippers 3 are each executing a horizontal component of motion at release stations II, III and IV which corresponds with conveyor speeds so there is no drag at any of the release stations of the bottles being released on the outfeed conveyors.

An operating cycle of the machine begins with a gripper head 4 descending so that all of its grippers 3 can engage all bottles present in a container which is presently conveyed to bottle pick up or infeed station I. As indicated, conveyor 8 and the container 2 thereon and the gripper head 4 are all moving at the same velocity at the time the bottles are engaged by the grippers on the gripper head. As soon as the grippers descend to the height of the bottle mouths, all grippers 3 of head 4 are actuated to the gripping mode by control device 7 so that all bottles in the container 2 can be taken from it and transported toward the first container release station II. During this operation, the color of each individual bottle is determined by the respective sensors 5 associated with the gripper elements 3. When the first bottle release station II is reached, only those grippers 3 of head 4 are put in the release mode which have been sensed as holding bottles of a particular color. For example, only clear transparent bottles will be released at station II. All other grippers 3 remain in the gripping mode after the clear glass bottles, for example, are released at bottle release station II. The same gripper carrying head for moving bottles other than clear glass bottles departs from station II on conveyor belt 9 and is guided by the cam grooves to the second bottle release station III. At station III, control device 7 may cause, for example, release of all green bottles onto outfeed conveyor belt 10 by virtue of the fact that only grippers holding bottles of that particular color are switched to the release mode at station III. Finally, in this embodiment, residual bottles of the remaining color are carried over the top of loop 21 for descending to release station IV where the controller 7 effects release of the bottle, which, for example, may be colored brown.

The differently colored bottles, after arriving at their respective release stations II, III and IV are conveyed on conveyors 9, 10 and 11 to, for example, separate destinations such as to deposit the sorted bottles in cases. One of the conveyor belts may lead to a bottle washing machine or a bottle filler line.

I claim:

1. A method of sorting articles according to a characteristic of the respective articles including shape, height or color, comprising the steps of:

moving a plurality of gripper heads along a predetermined closed loop path, positioning at an unpacking station along said path a container occupied by unsorted articles, controlling grippers on a gripper head traversing the unpacking station to grip and remove all articles from the container and begin to move them along said path for traversing a series of article release stations arranged along said path, and detecting at least one characteristic of an article and controlling selected ones of the grippers on the gripper head to release their grip on articles having at least one common characteristic at respective release stations as the gripper head traverses the release stations consecutively.

2. A method according to claim 1 including the step of determining which articles are members of a class having at least one common characteristic before the articles are gripped at the unpacking station.

3. A method according to claim 1 including:

associating a sensor of article characteristics with each gripper on the gripper heads for determining the characteristics of the articles at least by the time the articles are moved to the first in the series of article release stations from the unpacking station.

4. A method according to any one of claims 1, 2 or 3 wherein moving of said gripper head occurs in a vertical plane.

5. A method according to any one of claims 1, 2 or 3 including:

establishing the release stations on conveyors, respectively, and operating the conveyors continuously for conveying the articles from the release stations to different destinations.

6. A method according to claim 1 including:

conveying the container of unsorted articles to the unpacking station and maintaining the container in motion as it traverses the unpacking station, and having the gripper head which grips the articles in the container arrive at the container moving substantially in the same direction and at the same velocity as the articles are being conveyed with the container.

7. A method according to claim 1 wherein the characteristic of the article on which sorting of it is based is its color.

8. A method according to any one of claims 1 or 7 wherein the articles are bottles and releasing the bottles at the release stations depends on the bottles having a common color.

9. A method according to claim 1 including:

releasing from the gripper head at the last in the series of article release stations any article remaining on the head that does not have a characteristic that qualified it for release at preceding release stations, and continuing to move the gripper head along said path to transverse the unpacking station again.

10. Apparatus for sorting articles according to a characteristic of the respective articles including shape, height and color, comprising:

a rotor driven rotationally about an axis and carrying a plurality of equiangularly spaced apart gripper heads through a closed loop path in a vertical plane, each gripper head having mounted to it groups of article grippers that are individually controllable to grip and release articles, for each gripper there is an associated detector that is operative to recognize at least one characteristic of an article, controller means operative to receive information pertaining to article characteristics recognized by the respective detectors and to control the grippers to grip or release each article depending on its characteristics, an unsorted article infeed station arranged along the path of the gripper heads for being traversed by the spaced apart gripper heads in succession, the controller means controlling the grippers on the heads to grip a plurality of articles as the head traverses the infeed station for carrying the articles along said path, and a plurality of article release stations arranged in succession along said path, said controller means controlling only grippers of articles which have at least one common characteristic to release those articles at the successive stations.

11. Apparatus according to claim 10 wherein said detectors are of the type that detect the color characteristic of the articles.

12. Apparatus according to claim 10 wherein said detectors are of the type that detect the height characteristic of the articles.

13. Apparatus according to claim 10 wherein said release stations are established on conveyors that carry off the sorted articles.

14. Apparatus according to claim 10 including an infeed conveyor having a zone constituting said article infeed station.

15. Apparatus according to claim 10 including:

an infeed conveyor having a zone constituting said article infeed station, said infeed conveyor arranged proximate to said closed loop path, and a plurality of outfeed conveyors that provide zones respectively constituting said release stations.

16. Apparatus according to claim 15 wherein said infeed conveyor is arranged at a level proximate to the lowermost part of said closed loop path for translating in a horizontal plane and said outfeed conveyors are arranged for translating respectively at variously different levels above said infeed conveyor.

17. Apparatus according to claim 16 including articulated lever systems supporting said gripper heads from the rotor, said lever systems are constructed and arranged for imparting a horizontal component of motion to the articles as they are released to the outfeed conveyors for the articles to have a velocity substantially corresponding to the outfeed conveyors.

* * * * *